US006193614B1

(12) United States Patent
Sasamoto et al.

(10) Patent No.: US 6,193,614 B1
(45) Date of Patent: Feb. 27, 2001

(54) GOLF CLUB HEAD

(75) Inventors: Akinori Sasamoto; Harunobu Kusumoto; Atsushi Matsuo; Yasuto Imai, all of Higashikurume (JP)

(73) Assignee: Daiwa Seiko, Inc., Tokyo (JP)

( * ) Notice: Subject to any disclaimer, the term of this patent is extended or adjusted under 35 U.S.C. 154(b) by 0 days.

(21) Appl. No.: 09/150,284

(22) Filed: Sep. 9, 1998

(30) Foreign Application Priority Data

Sep. 9, 1997 (JP) ..... 9-244138
Sep. 9, 1997 (JP) ..... 9-244139
Sep. 30, 1997 (JP) ..... 9-266894

(51) Int. Cl.[7] ..... A63B 53/04

(52) U.S. Cl. ..... 473/329; 473/342; 473/345; 473/346; 473/349; 473/350

(58) Field of Search ..... 473/324, 325, 473/330, 331, 342, 347, 345, 346, 348, 349, 350, 329

(56) References Cited

U.S. PATENT DOCUMENTS 4,792,140 * 12/1988 Yamaguchi .
4,809,978 * 3/1989 Yamaguchi .
5,024,437 * 6/1991 Anderson .
5,100,144 * 3/1992 Okumoto .
5,207,427 * 5/1993 Saeki .
5,342,812 * 8/1994 Niskanen .
5,417,419 * 5/1995 Anderson .
5,437,088 * 8/1995 Igarashi .
5,445,382 * 8/1995 Pearce .
5,779,560 * 7/1998 Buck .

FOREIGN PATENT DOCUMENTS 6-269518 9/1994 (JP) .
8-280855 10/1996 (JP) .
2605962 2/1997 (JP) .

* cited by examiner

*Primary Examiner*—Sebastiano Passaniti
(74) *Attorney, Agent, or Firm*—Liniak, Berenato, Longacre & White

(57) ABSTRACT

A golf club head which can be reduced in its thickness with no fear of impairing the durability and strength of the club head. A face portion of the golf club head is configured such that the vertical dimension of the face portion is smaller than the horizontal dimension thereof, and the face portion is arranged so as to satisfy any of the following conditions: 1) the longitudinal direction of crystal grains of a material of the face portion is oriented in the vertical direction of the face portion; 2) the direction in which the material exhibits a large ductile amount at the time of breaking is oriented in said vertical direction; and 3) the direction in which the material exhibits a large ratio of ductility per unit length is oriented in said vertical direction.

4 Claims, 16 Drawing Sheets

FIG.9/(a)
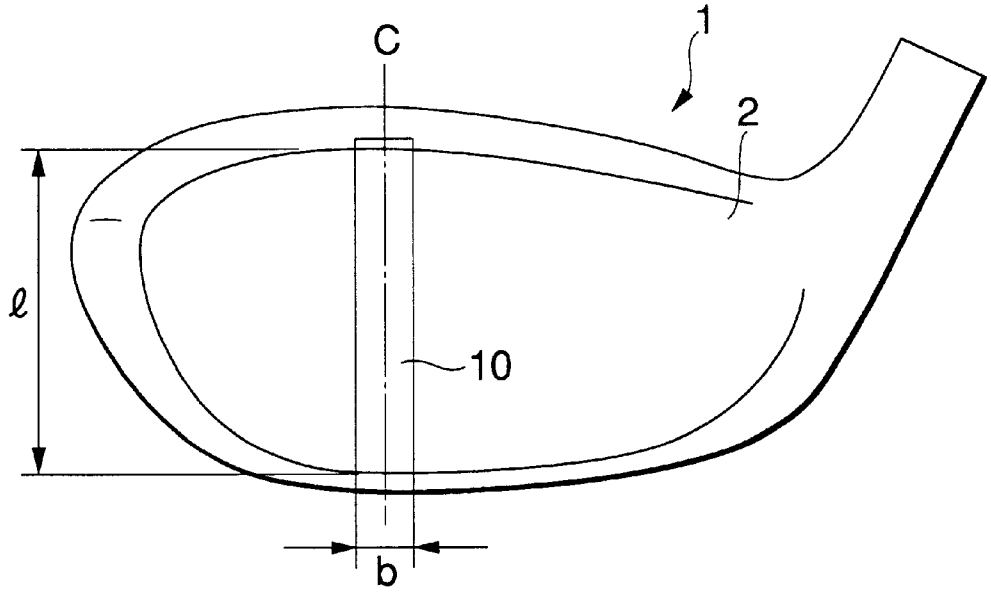
FIG.9(b)
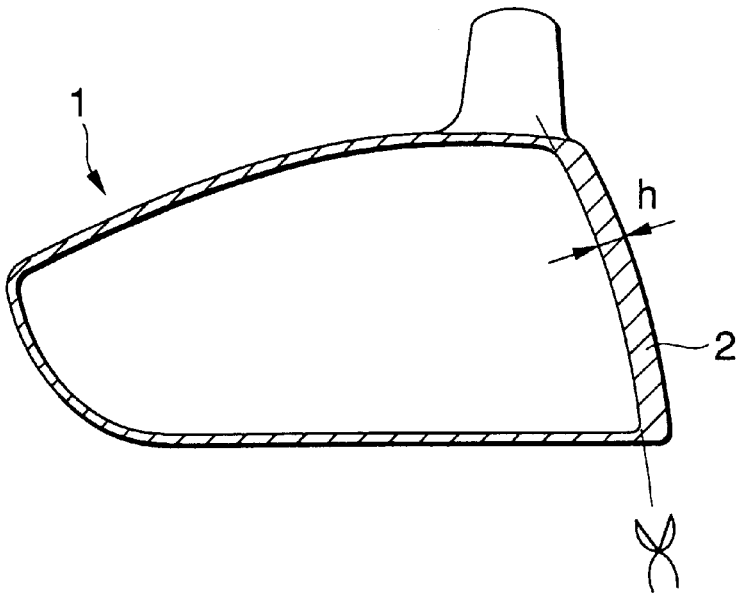

GOLF CLUB HEAD

BACKGROUND OF THE INVENTION a) Field of the Invention

The present invention relates to a golf club, and more particularly to a golf club with an improved head.

b) Related Art (1) A recent trend of the golf club is that the club head is made of a metallic material, and formed with a shell having a hollow interior. Increase of the club head size and thinning of the face portion of the club head and other tendency progress. The theory teaches that the size increase of the club head accrues to the increase of a moment of inertia and the enlargement of the sweet spot, and hence to the stabilization of the flying direction of a ball, and that the thinning of the club face accrues to reduction of the weight of the whole golf club, and hence to the increase of a flying distance. A specific example of the implementation of the theory is disclosed in Japanese Patent No. 2605926. In the example, the face portion of the golf club is 2 mm to 3.5 mm thick, the crown portion is 0.6 mm to 2 mm thick, and the sole portion is 1 mm to 3 mm thick. The face portion is broadened (40 mm or longer in vertical length and 70 mm or longer in horizontal length). The golf club thus dimensioned succeeds in stabilizing the ball flying direction and increasing the ball flying distance.

Thus, the thinning and enlarging of the face portion and the like improve the characteristics of the golf club indeed, but suffers from the following problems. Particularly the face portion (i.e. the ball striking surface) is liable to broken. A crack, formed in the ball striking surface, grows through its long time use. In other words, its durability is not satisfactory. For this reason, there is a limit in increasing the size of the club head, and hence reducing its weight and adjusting a weight distribution in the club head.

Proper selection of the material for the club head and the method of manufacturing the same may solve those problems to some extent. For example, where a $\beta$ alloy is used for titanium, the face portion, for example, may be reduced in thickness since its strength is higher than that of a pure Ti $\alpha$ alloy and $\alpha\beta$ alloy. When the rolling is used for manufacturing the club head, the crystal grains are fined and increased in density, to increase a strength of the club head.

Use of those techniques still fails to achieve a satisfactory thinning and enlarging of the face portion. The reason for this will be described with reference to the related drawings attached to this specification.

Reference is made to FIGS. 1, 2(*a*) and 2(*b*) for explaining the whole golf club. Of those figures, FIG. 1 is a view showing the whole construction of a golf club. FIG. 2(*a*) is a front view showing a club head of the golf club, and FIG. 2(*b*) is a cross sectional view taken on line A—A in FIG. 2(*a*).

In those figures, reference numeral 1 is a shaft; 2 is a grip; and 5 is a club head. The club head 5 has a neck 6 to which the shaft 1 is attached, and its configuration is defined by a face portion (a ball striking surface) 7, a top-side (crown) portion 8, a toe-side portion 9, a heel-side portion 10, a sole portion 11, and a back-face portion 12. Those surface portions are demarcated by ridge lines 15. Score line grooves 7*a* are formed in the face portion 7 to impart a spinning motion to a ball when striking the ball.

A deformation state of the club head when the face portion 7 of the club head strikes a ball will be described with reference to FIG. 3. As shown in FIG. 3, as the result of the recent tendency of size increasing, the face portion 7 of the club head is configured to be short in height and long in width, and its depth (thickness) is h. In the area serving as a sweet spot of the face portion 7, the horizontal length X is longer than the vertical length Y.

At the instant that the face portion 7 thus configured impacts against the ball, the face portion 7 is entirely deformed (deflected) toward the back-face portion. Specifically, an impact produced when striking the ball deforms the face portion 7 in the X and Y directions. In this case, an amount of deformation X1 in the X direction is not equal to that Y1 in the Y direction. The deformation amount Y1 is larger than the deformation amount X1 since the dimension of the face portion when viewed in the X direction is larger than that in the Y direction at the center P of the sweet spot when the deformation amounts are measured per unit length.

Thus, the deformation amount per unit length in the vertical direction is larger than that in the horizontal direction. Because of this, the face portion is liable to crack in the horizontal direction. With the increase of the head size, the horizontal size of the club head is larger, so that the deformation amount per unit length increases to further promote its fissuring.

The present invention was made in view of the facts that, when an impact is applied to the face portion, the deformation amount per unit length at the center on the face portion differs with the directions, viz., the deformation amount in the long-dimension direction of the face portion is different from that in the short-dimension direction, and that this hinders the thinning of the club head.

With the increase of the club head size, the face portion, for example, of the golf club is configured such that the horizontal length (the length in the long-dimension direction) is increased. Therefore, crack and breakage in the horizontal direction is liable to be formed in the face portion. In designing the conventional golf club, the above discovery is not taken into consideration, and a conventional measure taken for the crack formation problem is to merely increase the thickness of the face portion. The conventional technique is confronted with difficulties of reducing in thickness those surface portions and other surface portions of the club head for the reason that the thinning of those surfaces leads to formation of crack.

Accordingly, an object of the present invention is to provide a golf club with a club head which may be reduced in its thickness with no fear of impairing the durability and strength of the club head.

(2) As disclosed in Japanese Patent Laid-Open Publication No. Hei-6-269518), if the ball is greatly elastically deformed when it is hit, the energy imparted to the ball is consumed for the motion to restore the deformed ball to its original form. As a result, the flying distance of the ball is not increased.

To prevent the face portion of the club head from being deformed inward and permanently deformed so when hitting the ball, a ratio of a durability of $\sigma$ of the face portion to an elastic modulus (Young's modulus) E thereof ($\sigma$/E) is set at $5\times10^{-3}$ or larger. In other words, when hitting the ball, the face portion is made elastically deformed inward, whereby an elastic deformation of the ball is minimized to thereby increase the flying distance of the ball.

Only increasing of a strength of the face portion to withstand some amount of deformation of the face portion fails to optimize a coefficient of rebound or restitution of the face portion when hitting the ball, to increase the flying distance, and to secure a directional stability of the ball. To prevent an extreme deformation of the ball when the face portion impacts on the ball and to optimize the coefficient of restitution of the face portion, it is necessary to adjust a flexure amount of the face portion. If a flexure amount of the face portion when hitting the ball is calculated in advance and the face portion is designed to have an optimum flexure amount when hitting the ball, it is possible to optimize the coefficient of restitution of the face portion, to increase the flying distance of the ball, and to secure the directional stability of the ball.

Through the investigation on the flexure characteristic of the face portion of the club head, the facts were discovered in that a flexure amount of the face portion per unit length when hitting the ball is larger in the vertical direction (the short-dimension direction) of the face portion than in the horizontal direction (the long-dimension direction), and that a flexure amount of the face portion depends greatly on the conditions of the face portion in the vertical direction. The present invention was made in view of these facts, and an object of the invention is to provide a club head of a golf club which is configured so as to have an optimum flexure amount of the face portion of the club head in the vertical direction, whereby a coefficient of restitution of the face portion when hitting the ball is optimized, the flying distance is increased, and the directional stabilization of the ball is secured.

(33) Generally, the club head of the gold club can be thinned using a material of high strength, and be increased in size and reduced in weight. The theory teaches that the size increase of the club head increases its inertia moment and enlarges its sweet spot, and weight reduction of the club head leads to increase of its swing speed, and as a result, the directional stability of the ball is secured and the flying distance of the ball is increased. For this reason, recently, various kinds of materials of high strength are sued for the club heads. With use of those kinds of materials, a designer can design club heads with an increased design freedom while satisfying various characteristic requirements.

The face portion of the club head is flexed by an impact produced when striking a golf ball. Therefore, it is liable to flaw and to be worn, and will crack through a long time use, and is inferior in durability to other portions of the club head. For this reason, for the face portion of the club head, such a material, e.g., stainless or titanium, which is different from that of the club head, as to withstand an impact produced when striking the ball, is processed by forging or the like to form a face plate (the same material as of the club head may be used if it is able to withstand the impact). The face plate is mounted on the club head. Reduction of the face plate in weight accrues to increase of the gravity center depth, and hence increase of the sweet spot, as in the case of the weight reduction of the head body. Accordingly, a design freedom in designing the club head is increased.

As is known, a fiber reinforced metal (FRM) as a metal reinforced with reinforced fibers in order to increase a strength of a material constituting the face plate and to reduce the weight thereof, is used for the material of the face plate. Japanese Patent Laid-Open Publication No. Hei-8-280855 discloses a composite reinforced material in which titanium, aluminum alloy or the like is used for a matrix, and reinforced fibers made of silicon carbide, boron or the like is used for a reinforcing material.

Since the FRM is such that a metal is reinforced with reinforced fibers, it is desirable that a percentage of the reinforced fibers contained in the matrix is large. In a case where to form an FRM, a matrix is a material suitable for the face plate, e.g., aluminum, titanium, stainless or the like, and reinforced fibers is mixed into the matrix, a process of high temperature and high pressure is inevitably carried out. Therefore, the process possibly gives rise to change of properties of the reinforced fiber, oxidization of the material and the like. The result is to loosen the bounding of the matrix to the reinforced fibers, to generate air bubbles in spaces between the matrix and the reinforced fibers, and to reduce a strength of the material. As a consequence, an attempt to increase the percentage of the reinforced fibers contained in the matrix is rejected.

To bring out the best in the reinforced fibers of the composite reinforced material, a preferable material for the matrix is relatively soft and easy to interdiffuse, good in wetting properties with the reinforced fibers, and lower in melting point than the reinforced fibers.

As already stated, the face plate is flexed by an impact produced when hitting the ball, and the resultant flexure causes a bending stress in the face plate. A magnitude of the bending stress is proportional to a distance from the neutral axis of the face plate, viz., it increases as the distance increases. The face plate made of FRM may be increased in its strength, thinned in thickness, and reduced in weight in a manner that a reinforced fiber layer is disposed apart from the neutral axis as much as possible to increase a rigidity of the fiber layer contained portion.

Where such a material as to be relatively soft and easy to interdiffuse, good in wetting properties with the reinforced fibers, and lower in melting point than the reinforced fibers, is used for the matrix, the face plate made of the material is easy to be worn by an impact produced when hitting the ball, and hence is unsatisfactory in durability. Locating the reinforced fiber layer close to the hitting surface thereof creates some problems. A portion close to the hitting surface is worn by the impact, so that the reinforced fiber is liable to be exposed there. The exposed reinforced fibers impair the look of the club head, and possibly cause-crack in the club head. The crack of the club head reduces a strength of the club head. For this reason, there is a limit in reducing a distance of the reinforced fiber layer to the hitting surface.

Accordingly, an object of the present invention is to provide a structure of an FRM face plate mounted on the club head of a golf club, which the structure allows the reinforced fiber layer to be located close to the hitting face of the club head.

SUMMARY OF THE INVENTION (1) The present invention provides a golf club head in which the longitudinal direction of each crystal grain of a material forming the face portion having long- and short-dimension directions perpendicular to each other is oriented in the short-dimension direction.

(2) The present invention further provides a golf club head of a hollow shell type. The golf club head has a face portion mounted on the head body thereof. The face portion is configured so that a value of $1/E\times(1/h)^3$ is within a range from 0.7 to 16.0.

(3) The present invention further provides a golf club head having a face plate made of fiber reinforced metal as a metal reinforced with reinforced fibers. A surface treatment layer is formed on the surface of the face plate, and a metal layer is formed between a reinforced fiber layer and the surface treatment layer.

The present disclosure relates to the subject matter contained in Japanese patent application Nos. Hei. 9-244138

(filed on Sep. 9, 1997), Hei. 9-244139 (filed on Sep. 9, 1997), and Hei. 9-266894 (filed on Sep. 30, 1997), which are expressly incorporated herein by reference in their entireties.

BRIEF DESCRIPTION OF THE DRAWINGS

FIG. 2(*b*) is a cross sectional view taken on line A—A in FIG. 2(*a*).

FIG. 5(*b*) is a perspective view showing a face portion and a sole portion of the club head.

FIGS. 9(*a*) and 9(*b*) are diagrams for explaining how to slicing out a test piece for flexure measurement; FIG. 9(*a*) is a front view showing a club head of a golf club having a face portion, and FIG. 9(*b*) is a cross sectional view of the club head sliced along lines on a regional portion including a position where a face portion of the club head has a maximum vertical dimension.

FIG. 13(*a*) is a front view showing the club head; FIG. 13(*b*) is a cross sectional view taken on line A—A; and FIG. 13(*c*) is an enlarged view showing a face plate of the club head.

DETAILED DESCRIPTION OF THE PREFERRED EMBODIMENTS (1) The present invention provides a golf club head in which the longitudinal direction of each crystal grain of a material forming the face portion having long- and short-dimension directions perpendicular to each other is oriented in the short-dimension direction.

The golf club head thus constructed will be described in detail with reference to FIGS. 4(*a*) and 4(*b*). When a member having the face portion, for example, is manufactured by a manufacturing method including a rolling process, crystal grains of the member are made finer and increased in density. In this case, during the rolling process, the crystal grains of the member are gradually extended while being fined, and finally are arranged in a multiple of layers while being extended in the rolling direction. The resultant plate member having a multi-layered structure is subjected to a breaking test as shown in FIGS. 4(*a*) and 4(*b*).

Figure 4A:
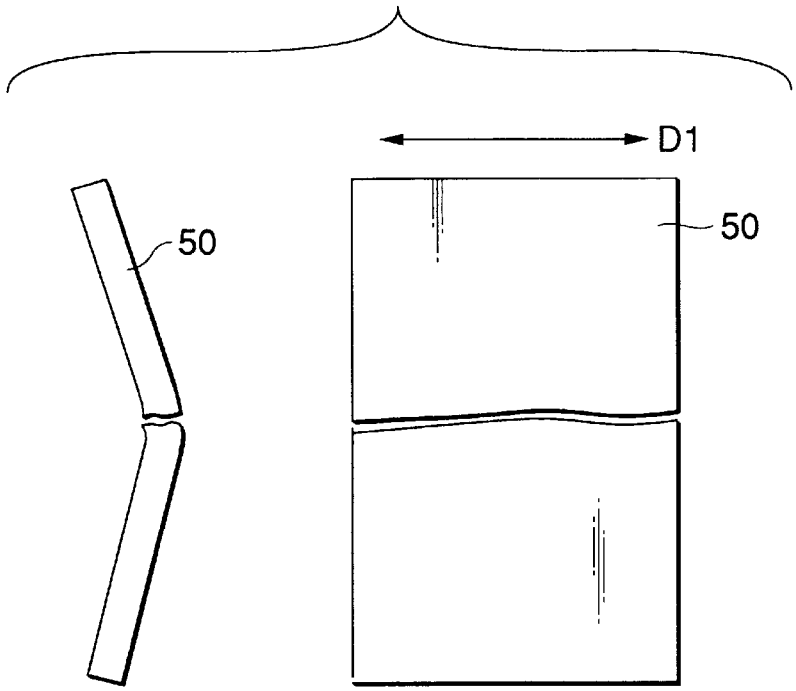
FIGS. 4(*a*) and 4(*b*) are diagrams showing the results of a breaking test conducted for two plate members formed, by rolling, in different rolling directions.
Figure 4B:
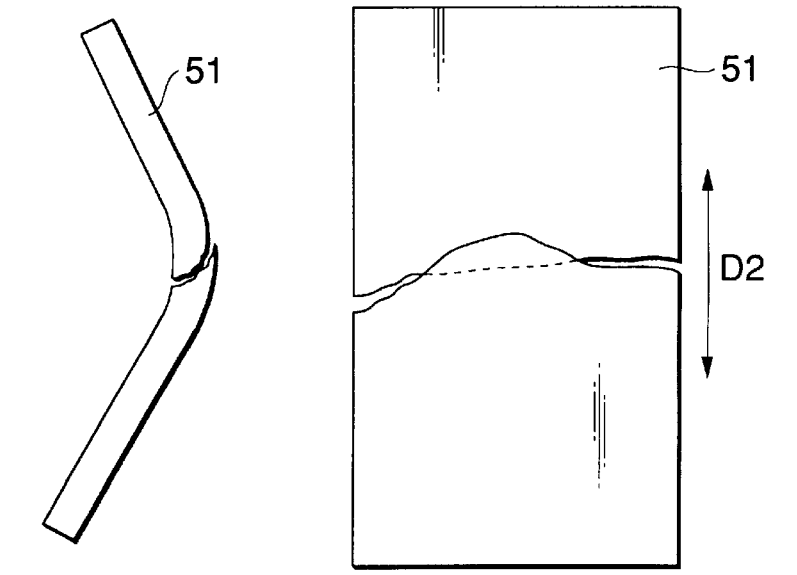

In FIG. 4(*a*), a plate member 50 has the rolling direction of an arrow D1. In FIG. 4(*b*), a plate member 51 has the rolling direction of an arrow D2. In the plate member 50, its crystal grains are fined, increased in density, and elongated in the direction D1. In the plate member 51, its crystal grains are fined, increased in density, and elongated in the direction D2.

A bending stress is progressively imparted to those plate members 50 and 51 (see the left sides of FIGS. 4(*a*) and 4(*b*)). The plate member 50 the crystal grains of which are oriented as shown in FIG. 4(*a*) is linearly broken as shown. The plate member 51 the crystal grains of which are oriented as shown in FIG. 4(*b*) is broken in a complicated or zig-zag fashion as shown, and is not separated until it is greatly deformed. A strength of breaking of the plate member 51 is substantially equal to or somewhat larger than that of the plate member 50, and the amount of deformation of the plate member 51 is large particularly when it is broken. A 3-point bending test was actually conducted on those plate members. In the test, the material of those plate members was Ti-15Mo-5Zr-3A1, and a force giving rise to a push of 5 mm in amount was loaded on those plate members. The test results were: the plate member 50 flawed at 13.29 kN (displacement: 2.7 mm); and the plate member 51 flawed at 12.86 kN (displacement: 5.4 mm). Thus, it was confirmed that those plate members 51 and 50 were substantially equal in the strength of breaking, but the amount of deformation of the plate member 51 at the time of breaking was larger than that of the plate member 50.

By imparting bending stresses to the plate members 50 and 51, flaw or crack tend to be formed in the direction D1. In the case of the plate member 50 whose crystal grains are oriented in the direction D1, flaw or crack, if formed, easily grow into the plate member, and hence the plate member is liable to be broken. In the case of the plate member 51 whose crystal grains are oriented in the direction D2 perpendicular to the direction D1 in which the plate member is easy to flaw, flaw or crack, even if formed, is hard to grow, and hence, the plate member 51 is hard to be broken.

Figure 3:
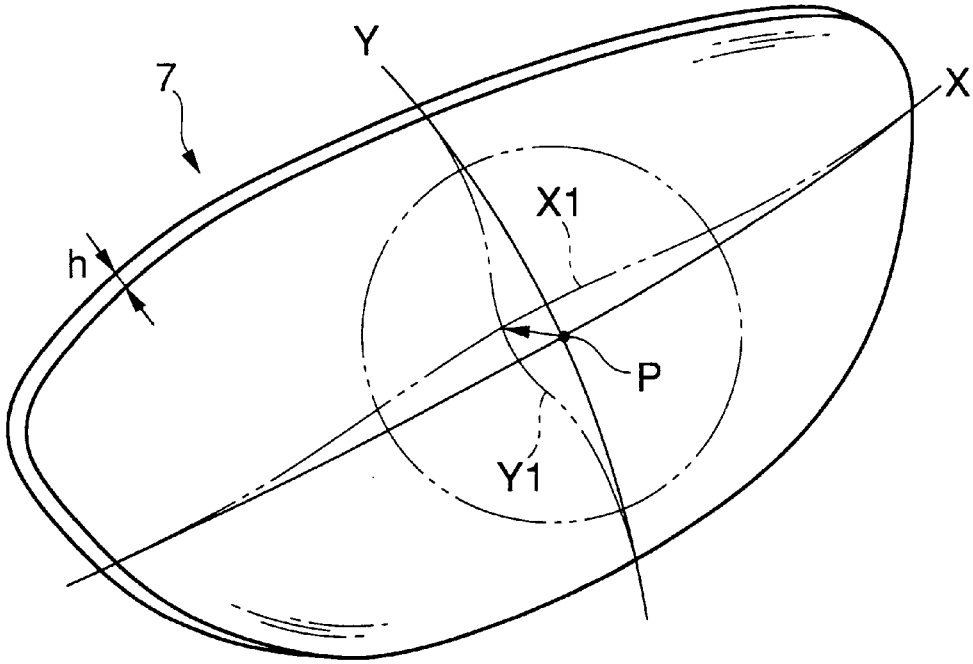
FIG. 3 is a diagram for explaining a deformation state of a club head when a face portion of the club head strikes a ball.

As already stated referring to FIG. 3, the amount of deformation at the center P on the face portion 7 when viewed in the direction Y is larger than that in the direction X. For this reason, the face portion 7 is easy to be broken by an impact produced when it strikes a ball. Our discovery described above teaches that to solve the easy-to-crack problem, the plate member is placed so that its crystal grains are oriented in the vertical direction. Thus, by imparting the hard-to-be broken structure to the plate member, the plate member of the face portion may be thinned while keeping a satisfactory strength of it, and weight reduction and size increase of the club head are realized.

To fine the crystal grains of the material of the face portion and increase a density of them, and to orient the crystal grains unidirectionally, casting may be used, instead of the rolling, in the manufacturing method. Titanium, titanium alloy, stainless, aluminum, soft iron, maraging steel, and the like may be enumerated for the materials which are suitable for the process to fine the crystal grains and increase a density of the same.

In the arrangement mentioned above, the longitudinal direction of the crystal grains of the material of the subject member, e.g., the face portion of the club head, being different in dimension in the directions perpendicular to each other, are oriented in the short-dimension direction of the subject member. In an alternative, the direction of the material of the subject member in which a deformation amount of ductile amount of the material at the time of breaking is large is be oriented in the short-dimension direction of the subject member. In another alternative, the direction of the material of the subject member in which a ratio of ductility of the material per unit length to a load acting thereon is large, is oriented in the short-dimension direction of the subject member. Further, the above three cases may be taken alone, or otherwise may be combined together.

Means to orient the direction of the material of the subject member, in which its ductile amount at the breaking is large, in the short-dimension direction of the subject member may be realized in a manner that a composite material, e.g., FRP or FRM, is used for the material of the face portion of the club head, and the orientation and the amount of the reinforced fiber, layer position, modulus of elasticity, and the like are adjusted. Another means is to use metal, FRP, FRM or the like for the material of the face portion, and to form an irregular surface on one or both sides of the face portion of the club head continuously or intermittently. Means to orient the direction of the material of the subject member in which its ratio of ductility per unit length to a load acting thereon is large in the short-dimension direction of the subject member may also be realized in a manner that a composite material, e.g., FRP or FRM, is used for the material of the face portion of the club head, and the orientation and the amount of the reinforced fiber, layer position, modulus of elasticity, and the like are adjusted. Another means is to use metal, FRP, FRM or the like for the material of the face portion, and to form an irregular surface on one or both sides of the face portion of the club head continuously or intermittently.

As described above, the present invention presents the following solutions to the problem of the prior art: 1) the first solution to orient the longitudinal direction of the crystal grains of the material of the subject member in the short-dimension direction of the subject member, 2) the second solution to orient the direction of the material of the subject member in which the material exhibits a large ductile amount at the time of breaking in the short-dimension direction of the subject member, 3) the third solution to orient the direction of the material of the subject member in which the material exhibits a large ratio of ductility per unit length to a load acting thereon, and 4) any of the combinations of the first to third solutions. Where any one of the solutions of the invention is used, the crack or the like of the subject member is impeded in their growing to the depth of the subject member. Therefore, the subject member may be reduced while keeping its strength at a satisfactory level.

In an aspect of the invention, the subject members constituting the club head of a golf club, e.g., a face portion, a crown portion, a toe-side portion, a heel-side portion, a sole portion, and a back-face portion, are arranged such that 1) the longitudinal direction of the crystal grains of the material of each subject member is oriented in the direction perpendicular to the ridge lines demarcating those surface portions, 2) the direction of the material in which the material exhibits a large ductile amount at the time of breaking in the direction perpendicular to the ridge lines demarcating those surface portions, 3) the direction of the material in which the material exhibits a large ratio of ductility per unit length to a load acting thereon in the direction perpendicular to the ridge lines demarcating those surface portions, or 4) any of the 1) to 3) orientations is properly combined.

The areas including the ridge lines demarcating the surface portions of the club head are easy to flaw or crack. This problem may easily be solved by applying any of the above unique technical ideas of the invention to those areas. In this case, the longitudinal direction of the crystal grains of the material, the direction in which the ductile amount of the material at the time of the breaking is large, or the direction in which the ratio of ductility per unit length to a load acting thereon is large, is oriented in the direction perpendicular to each ridge line. By doing so, the crack, if formed, is impeded in its growing to the depth of the subject member.

EXAMPLE

Figure 1:
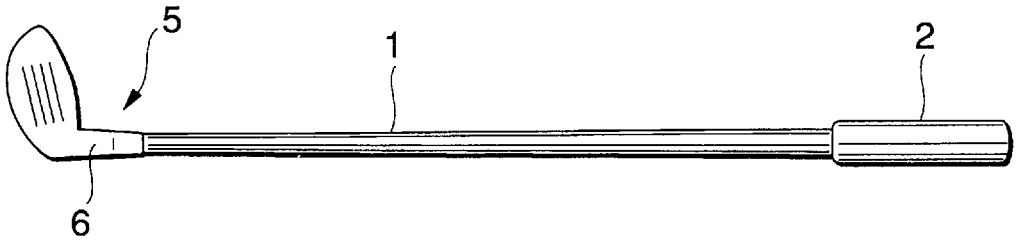
FIG. 1 is a view showing the whole construction of a golf club.
Figure 2A:
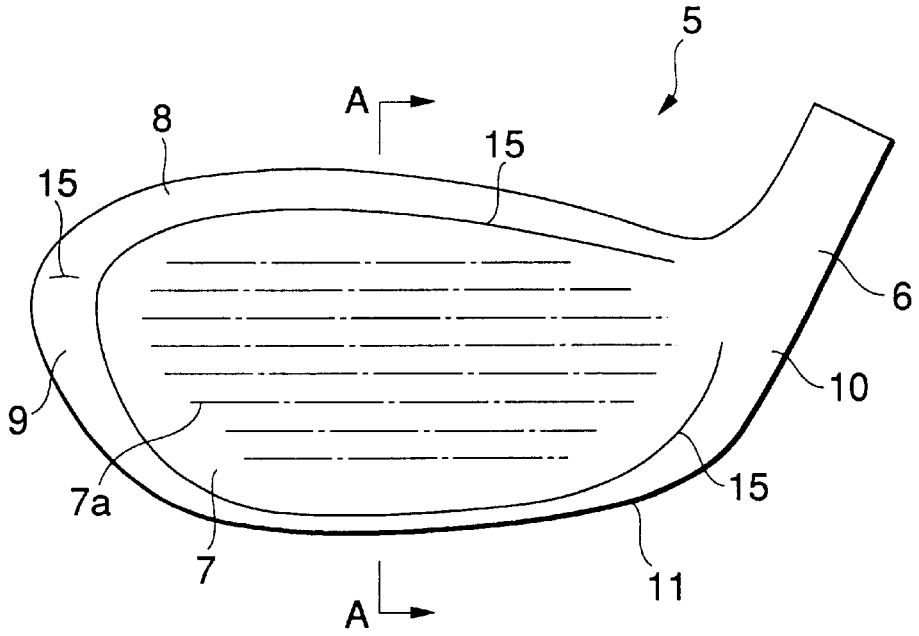
FIG. 2(*a*) is a front view showing a club head of the golf club.
Figure 2B:
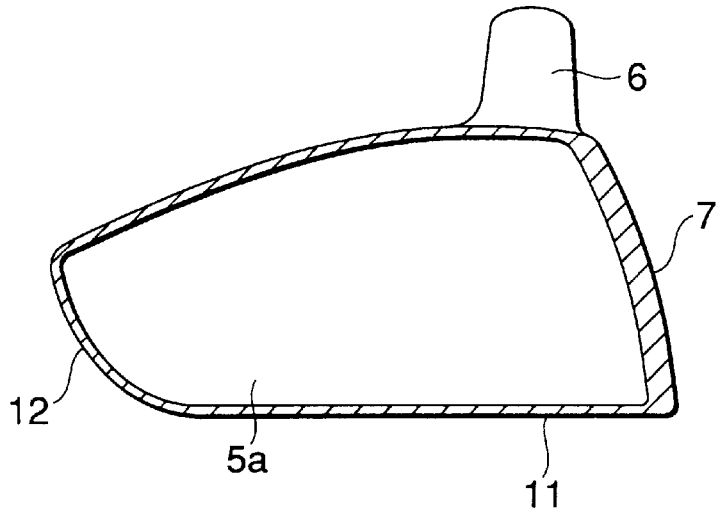
Figure 5A:
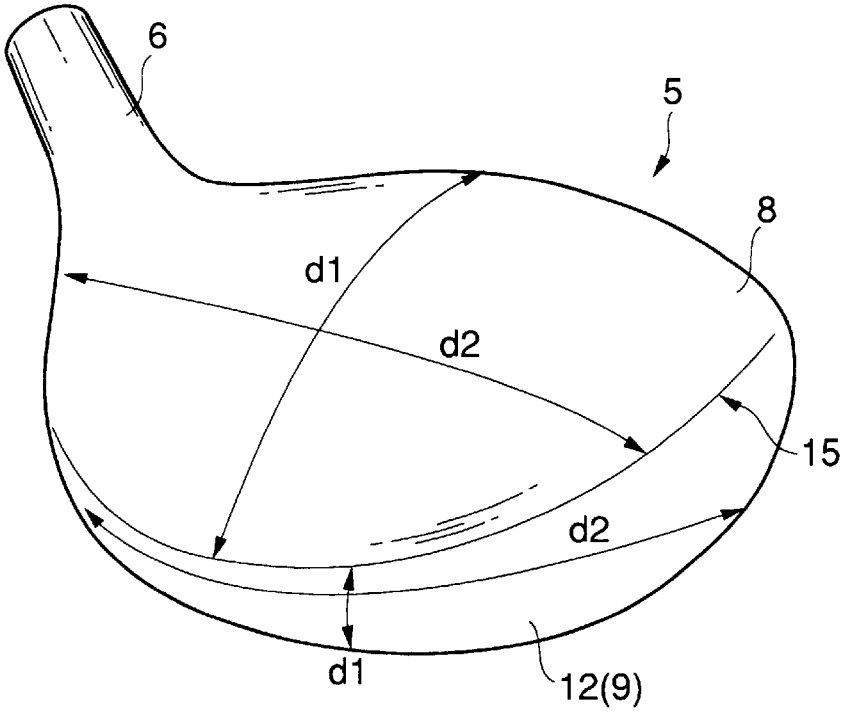
FIG. 5(*a*) is a perspective view showing a portion of the club head according to an embodiment of the present invention, which includes the upper-face or crown portion and the back face portion.
Figure 5B:
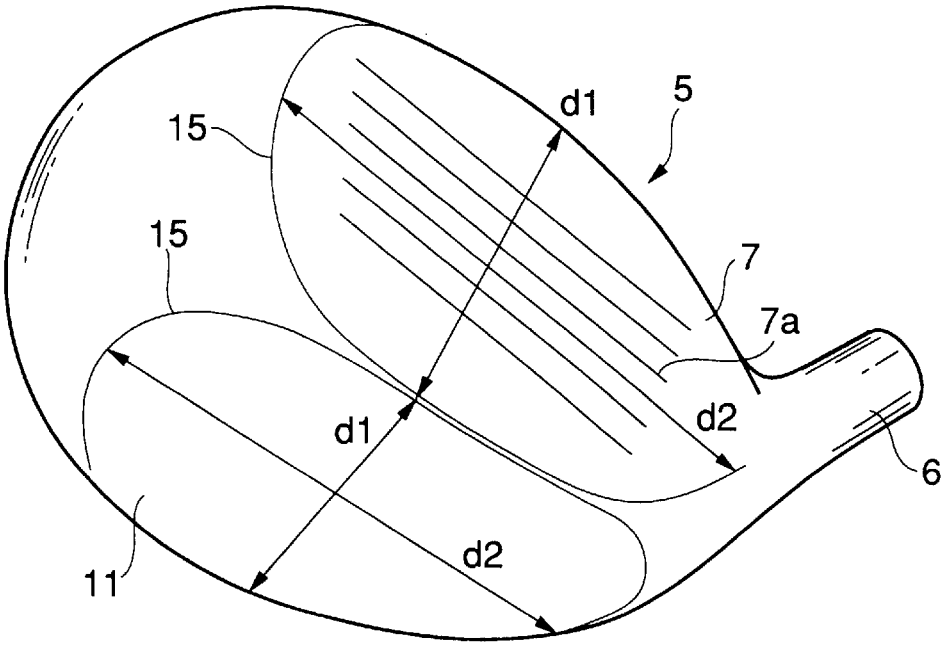

FIGS. 5(*a*) and 5(*b*) are views showing a club head of a golf club. The illustrated club head is of the wood type as shown in FIGS. 1 and 2. In FIGS. 5(*a*) and 5(*b*), like or equivalent portions are designated by like reference numerals used in FIG. 2, for simplicity. FIG. 5(*a*) is a perspective view showing a portion of the club head which includes the upper-face or crown portion and the back face portion. FIG. 5(*b*) is a perspective view showing a face portion and a sole portion of the club head. Generally, the club head of the wood type shown in FIG. 2 is formed with a hollow shell or a shell whose inside is filled with foamed resin or low specific gravity material.

In FIGS. 5(*a*) and 5(*b*), the short-dimension direction of each face portion is denoted as d1, and the long-dimension direction, as d2. In each face portion, the longitudinal direction of the crystal grains of the material, the direction in which the ductile amount of the material at the time of breaking is large and/or the direction in which the ratio of ductility per unit length to a load acting thereon is large, are oriented in the short-dimension direction dl.

Alternatively, the longitudinal direction of the crystal grains of the material, and the direction in which the ductile amount of the material at the time of breaking is large, and/or the direction in which the ratio of ductility per unit length to a load acting thereon is large may be oriented in the direction perpendicular to each ridge line 15, which demarcates the related surface portions of the club head. In the club head of FIGS. 5(*a*) and 5(*b*), the back-face portion and the toe-side portion are formed in an integral fashion.

In the thus constructed club head 5, crack or flaw formation is restricted in the directions in which each portion of the club head is liable to crack or flaw, viz., the direction (d2) perpendicular to the direction (d1) in which an amount of deformation per unit length is large or the direction along the ridge line 15. The result is that those portions of the club head may be thinned while keeping the strength thereof at a satisfactory level. That is, the face portion 7, crown portion 8, toe-side portion 9, sole portion 11, back-face portion 12 and the like, if necessary, may be thinned while keeping its necessary strength.

For example, if the face portion 7 is thinned, the gravity center of the club head is increased in depth; if the crown portion 8 is thinned, the gravity center is low. The weight distribution in the club head may be adjusted in a broad range while keeping required strength and durability of the club head. Therefore, increase of the flying distance and improvement of the directional stability of the ball are secured. The club head may be reduced in weight while keeping a required strength. This advantageous feature implies that the club head may further be increased in size.

Two club heads were manufactured for comparative performance confirmation. Ti-15Mo-5Zr-3A1 as a titanium alloy was used for the material of the face portions 7 of those club heads. The face portion of the first club head was formed of the material that was processed, by casing, to have no directionality of crystal grains. The face portion of the second club head was formed of the material that was processed, by rolling, to be fined and increased and density and to have the directionality of crystal grains, as mentioned above. The longitudinal direction of the crystal grains is oriented in the vertical direction of the club head. In the first club head, when the thickness of the face portion was within the range of approximately 2.7 mm to 3 mm, no crack was formed in the face portion in a normal use condition. In the second club head, when the thickness was approximately 1.5 mm to 2.6 mm, no crack was formed in the face portion in a normal use condition. These figures show that a satisfactory thinning of the face portion is secured.

As stated above, the present invention is based on the discovered fact that each face portion of the club head having long- and short-dimension directions perpendicular to each other, has a large deformation per unit length in the short-dimension direction, and hence is easy to crack in the long-dimension direction. The face portion having the long- and short-dimension directions is present not only in the surface portions defining the club head, but also in the portions defined by thick portions or rib portions.

Figure 6:
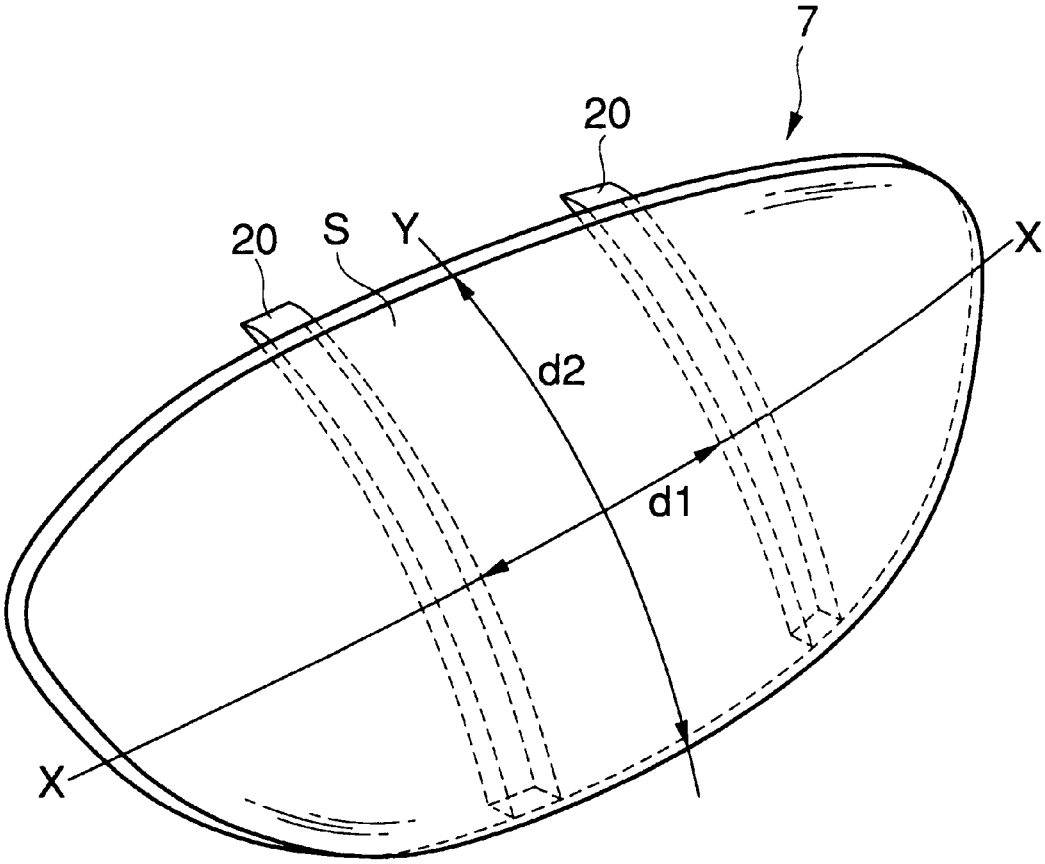
FIG. 6 is a view showing another club head of which the face portion is different from that of the above one.

In some type of club head, a face portion 7, as shown in FIG. 6, is mounted on a head body in a state that ribs 20 are interposed therebetween. In this type of club head, the X direction of the face portion 7 corresponds to the long-dimension direction, and the Y direction, to the short-dimension direction (FIG. 3), when observing the face portion 7 as a whole. In the area S between the ribs 20, the X direction of the face portion 7 is the short-dimension direction, and the Y direction is the long-dimension direction.

In the case where a subject portion or surface portion forming the club head is defined by thick portions or rib portions as shown in FIG. 6, the solution of the invention is applied to the defined area: the longitudinal direction of the crystal grains of a material of the subject portion, the direction in which the material of the subject portion exhibits a large ductile amount at the time of breaking, or the direction in which the material exhibits a large ratio of ductility per unit length to a load acting thereon is oriented in the short-dimension direction (d1).

It is evident that the present invention is applicable for an iron type golf club as well as the wood type golf club.

As seen from the foregoing description, the club head of the golf club constructed as described above can be thinned while keeping good strength and durability. This features accrues to weight reduction of the whole club head, size increase of the club head, increase of the flying distance, and improvement of the directional stability of the ball. An adjustment freedom of the weight distribution and a design freedom of the golf club are increased.

Figure 7A:
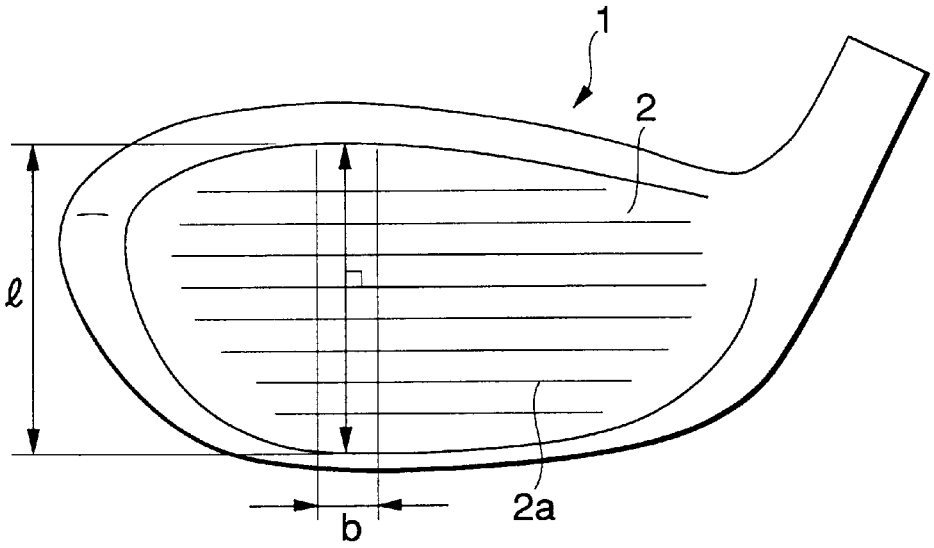
FIG. 7(*a*) is a front view showing a club head of a golf club having a face portion, and FIG. 7(*b*) is a cross sectional view of the club head sliced along lines on a regional portion including a position where a face portion of the club head has a maximum vertical dimension.
Figure 7B:
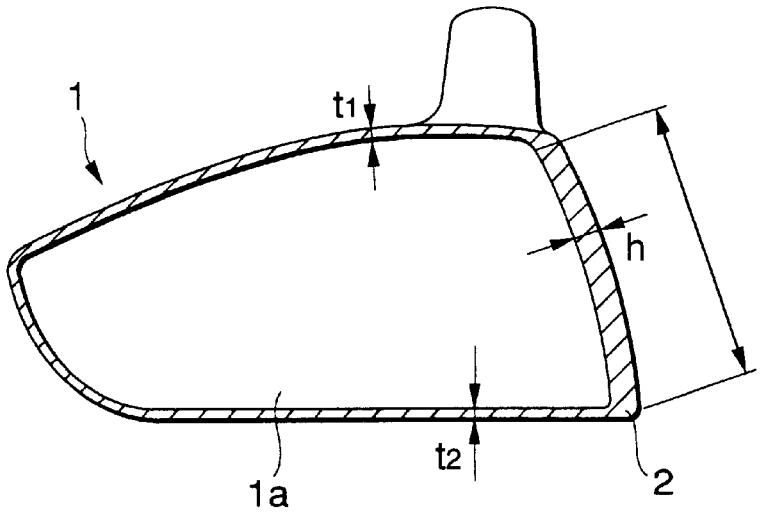

(2) The present invention further provides a golf club head of a hollow shell type. The golf club head has a face portion mounted on the head body thereof. The face portion is configured so that a value of $1/E\times(1/h)^3$ is within a range from 0.7 to 16.0. Here, the club head of the hollow shell type, as shown in FIG. 7(*b*), is formed with a hollow shell or a shell 1*a* whose inside is filled with foamed resin or low specific gravity material.

As already described, a flexure amount of the face portion depends largely on the conditions of the face portion in the vertical direction. Hence, the invention optimizes a flexure amount of a regional portion of the face portion where the face portion takes a maximum dimension in the vertical direction (in most cases, a regional portion within a range of ±15 mm of a position where the face portion takes a maximum dimension in the vertical direction has a sweet spot area of the club head.).

The invention will be described in detail with reference to FIGS. 7(*a*) and (7).

A face portion 2 mounted on a head body 1 of a golf club is sliced along lines on a regional portion including a position where the face portion takes a maximum dimension l in the vertical direction to form a test piece of a proper width. In a case where score lines 2*a* are formed in the face portion 2, the maximum dimension l is measured at a position where the vertical length of the face portion is maximized in the direction perpendicular to the score lines. Usually, that position lies at a point deviated to the toe side from the center of the face portion.

A test piece of l long, b wide, and h high is presented. An actual test piece sliced out includes the crown portion and the sole portion, and hence it is somewhat longer than the maximum dimension l. To a flexure measurement, the test piece of l (exactly) long is supported at both ends, and a predetermined load P is imparted to the test piece. Then, the test piece is flexed. An amount of the flexure of the test piece is defined as $\sigma=(P\times l^3)/(48E\times I)$. In the expression, I is a second moment of area, and mathematically expressed by $I=(b\times h^3)/12$. Substituting I into the expression of the flexure amount σ, then we have $\sigma=P/(4b)\times(1/E)\times(1/h)^3$.

In the expression of σ, $P/(4b)$ is a constant, $(1/E)\times(1/h)^3$ varies with a material constituting the face portion, head size (size of the face portion) and thickness of the face portion. Thus, the flexure amount σ is proportional to $(1/E)\times(1/h)^3$.

A relation between the thus calculated flexure amount σ and the flying distance of the ball was empirically examined. The result of the examination showed that when $(1/E)\times(1/h)^3$ was within a range from 0.7 to 16.0, a desired flying distance was secured (viz., when the ball is hit with a club head having a face portion whose $(1/E)\times(1/h)^3$ takes a value within the above range). The reason why the value of $(1/E)\times(1/h)^3$ is selected to be less than 16.0 is that if it is greater than 16.0, the face portion is liable to be broken and the flying distance of the ball is reduced. The reason why the value of $(1/E)\times(1/h)^3$ is selected to be greater than 0.70 is that if it is less than 0.70, the ball when hit with the club head is liable to be compressed, so that energy imparted to the ball when hitting the ball is consumed by the motion to restore the deformed (compressed) ball to its original form, and the flying distance of the ball is not increased. Our test showed that when $(1/E)\times(1/h)^3$ was within a range from 0.85 to 5.0, the ball was properly deformed and exhibited a proper coefficient of restitution, and the flying distance was desirable.

Figure 8:
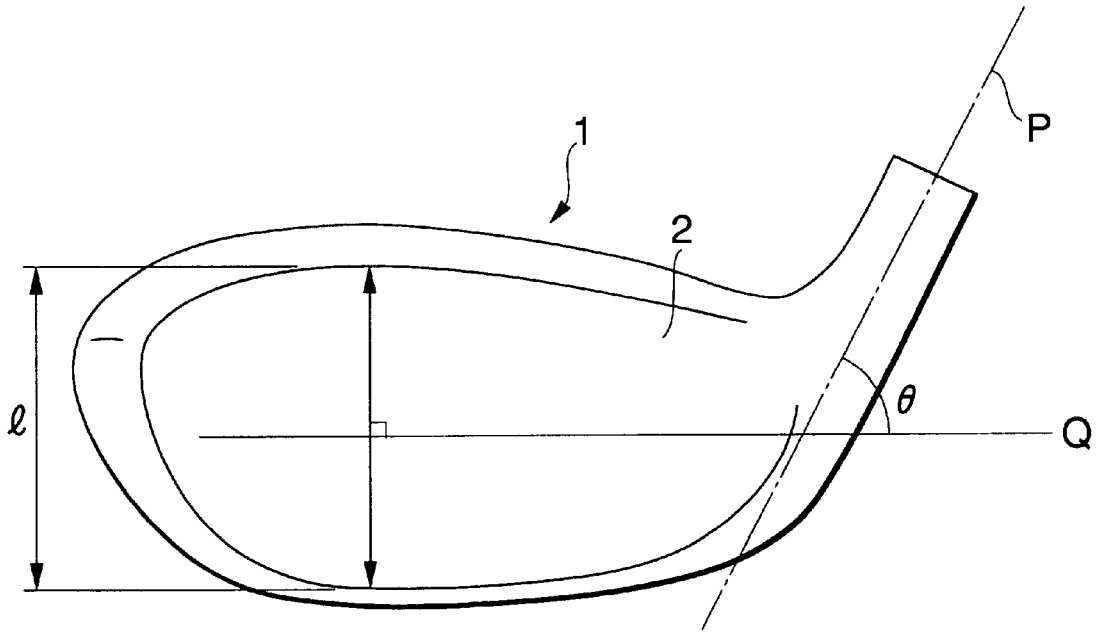
FIG. 8 is a front view showing a club head of a golf club, the illustration showing how to specify score lines on a face portion of the club head.

When score lines 2*a* are not formed on the face portion 2 or unclear, a line Q which is inclined at an angle Θ=56° with respect to the axial line P of the shaft is used as a score line (FIG. 8).

The face portion thus far discussed has neither ribs nor thick portions on the rear side thereof. In an actual face portion, however, ribs or thick portions are formed on the rear side of the face portion, and it may be impossible to specify the face portion thickness or its Young's modulus. In this case, a flexure amount σ of the face portion is actually measured by a flexure measuring method (X) to be described hereunder, and the face portion is designed such that its flexure amount σ actually measured is within a range from 0.17 mm to 4.0 mm.

[Procedure of the flexure measuring method (X)]

Reference is made to FIGS. 9(*a*) and 9(*b*).

A position on the face portion where the face portion has a maximum dimension l in the vertical direction is determined. Specifically, that position (referred to as a maximum-dimension position) is a position where the face portion has a maximum dimension l in the direction perpendicular to the score line or the line inclined at 56° with respect to the axial line of the shaft. The maximum-dimension position is indicated by a one-dot chain line C in FIG. 7(*a*).

The face portion is sliced along lines that are 5 mm apart from the line C and parallel to the latter to produce a test piece 10 of 10 mm wide. The reason why the width of the test piece 10 is selected to be 10 mm follows. The surface of the face portion 2 is not flat but slightly curved, and therefore if its width is longer than 10 mm, it is difficult to support points to be given later. If it is shorter than 10 mm, a flexure amount σ obtained through a measurement is not reliable.

Figure 10:
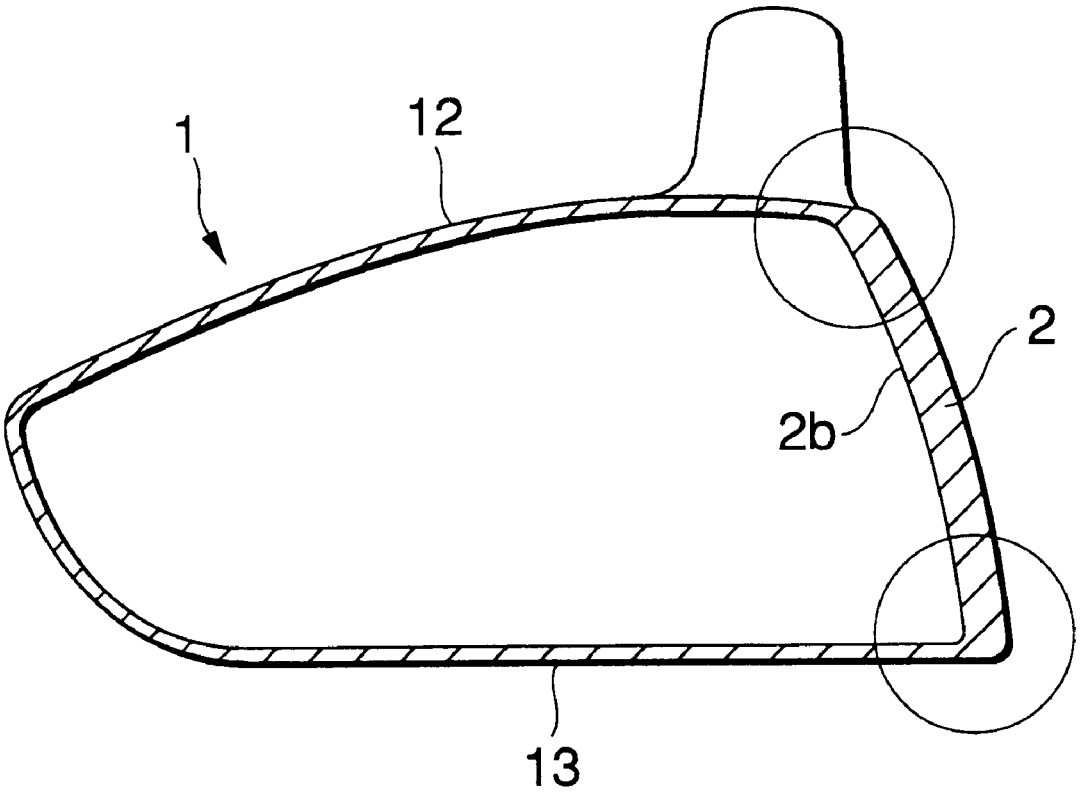
FIG. 10 is an enlarged view showing the club head of FIG. 9(*b*).

It is suggestible that the face portion 2 is sliced along the rear side 2*b* of the face portion 2 so that the rear side of the test piece is flat. The reason for this follows. Thick portions 15 (FIG. 11) are present at the boundary regions (circled in FIG. 10) between the face portion 2 and the crown portion 12 and between the face portion 2 and the sole portion 13. Because of presence of the thick portions 15, it frequently fails to determine the support points for supporting the test piece 10 (to be described later).

Figure 11:
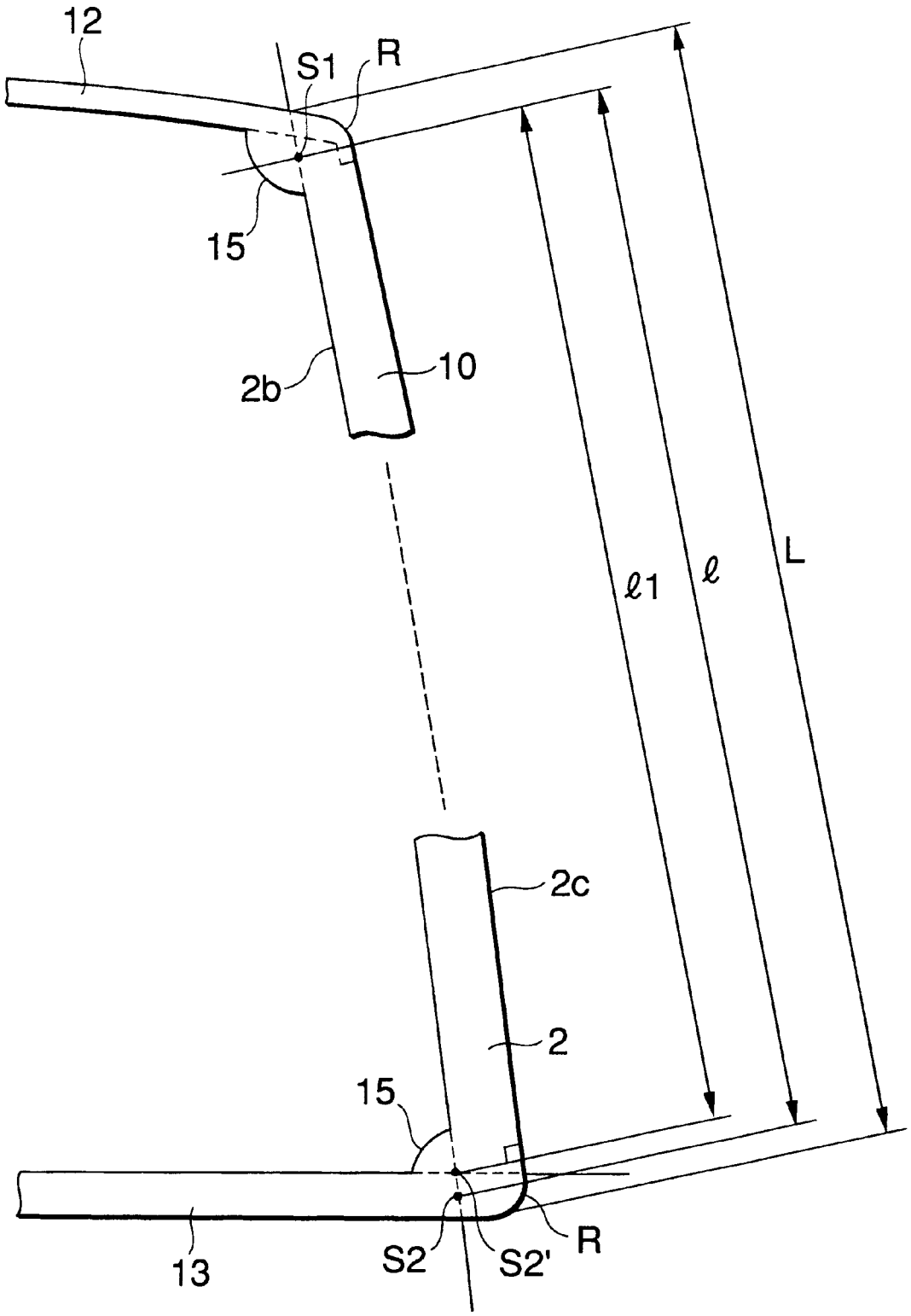
FIG. 11 is a diagram showing the face portion of the club head, the illustration showing how to slice out a test piece and to specify supporting positions for supporting the test piece.

The test piece 10 thus sliced out of the face portion 2 is supported at both ends, and a load is applied to the center of the test piece 10 stretched between the support points. The support points are denoted as S1 and S2 in FIG. 11, and are determined in the following manner (FIG. 11). To determine the support point S1, a straight line is vertically drawn from one end point of the surface (obverse) 2*c* of the face portion 2 where the surface 2*c* terminates and a curved face R continuous to the crown portion 12 begins, to the rear side 2*b* of the face portion 2. An intersection of the straight line and the rear side 2*b* is the support point S1. To determine the support point S2, a straight line is vertically drawn from the other end point where the surface 2*c* terminates and another curved face R continuous to the sole portion 13 begins, to the rear side 2*b* of the face portion 2. An intersection of the straight line and the rear side 2*b* is the support point S2. A distance between the support points S1 and S2 is l. When it is difficult to obtain a stability on the support points thus determined, a point where the inner surface of the sole portion 13 intersects the rear side 2*b* of the face portion 2 is used as a support point S2'. The test piece 10 defined by a distance l' between the support points S1 and S2' is subjected to the measurement of the flexure amount σ.

Figure 12A:
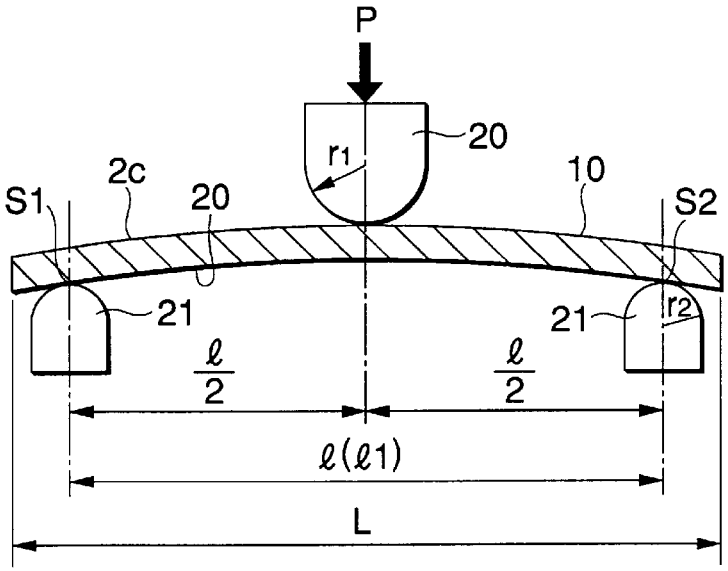
FIGS. 12(*a*) and 12(*b*) are diagrams showing a method for measuring a test piece.
Figure 12B:
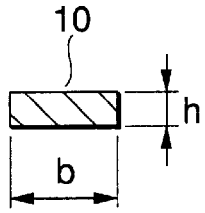

Both ends of the test piece 10 is supported at the support points S1 and S2 thus determined by support members 21, as shown in FIGS. 12(*a*) and 12(*b*). A pressing piece 20 is brought into contact with the center of the test piece 10 thus supported (when viewed longitudinally viewed), and a predetermined load P is applied to the test piece 10. The load P is 10 Kgf. A flexure amount σ is measured at the center of the test piece 10. The radius r1 of the pressing piece 20 is 5.0 mm, and the radius of each of the support members 21 is 3.0 mm. The width b of the test piece 10 is 10 mm (already stated). A distance between the support points is l. The length and the thickness of the test piece 10 are L and h. The thickness h is variable.

As already described, when ribs or thick portions are formed on the rear side of the face portion 2, and it may be impossible to specify the face portion thickness or its Young's modulus, a flexure amount σ of the face portion is actually measured by the flexure measuring method (X) described above.

The face portion 2 is designed so that its flexure amount a measured by the flexure measuring method (X) is within a range from 0.17 mm to 4.0 mm. The result is that the flying distance of the ball is increased while free from the breaking of the face portion. The reason for this is similar to the above mentioned one. A golf club with a club head was actually manufactured. A face portion of the club head was within a range from 0.21 mm to 1.25 mm in flexure amount σ. A test of the golf club was conducted. The test result was: The ball was properly deformed when hit with the club head, and a coefficient of restitution of the face portion at this time was also proper; and the flying distance was satisfactory.

EXAMPLE

A face portion of the club head is designed so as to satisfy the measuring values mentioned above: $1/E\times(1/h)^3$ is within 0.70 to 16.0 or a flexure amount of the face portion (measured by the flexure measuring method X) is within 0.17 mm to 4.0 mm. If so designed, there is no limiting condition on the material, size, and thickness of the face portion, and the head structure other than the face portion.

In the club head shown in FIG. 7(*b*), for example, for a material of the club head whose Young's modulus is approximately 8000 to 21000 Kgf/mm$^2$, the thickness t of the upper surface portion (crown portion) is 0.8 mm to 1.2 mm, preferably 0.8 mm to 1.2 mm, and the thickness t2 of the sole portion is 1.0 mm to 1.4 mm, preferably 1.1 mm to 1.3 mm. In this case, $1/E\times(1/h)^3$ of the face portion is selected to be 0.7 to 3.0. When the ball is hit with the club head thus constructed, the face portion is deformed and further the sole portion of t1 thick and the crown portion of t2 thick are deformed, to thereby prevent the ball from being deformed.

To increase a flexure amount of the face portion when hitting the ball, the following means may be used.

The height of the face portion, i.e., the size of the face portion in the vertical direction, is selected to be 54 mm or greater, preferably 56 mm or greater.

The face portion is as thin as possible. The thickness of the face portion is determined by a kind of material used and its shape; usually it is 3.0 mm or less or 2.5 mm or less, more preferably 2.0 mm or less. In this case, the face portion need to be thinned within a critical value of strength at which the face portion is broken.

The face portion may be made flexible by reducing the Young's modulus of a material of the face member, e.g., 12,000 Kgf/mm$^3$ or less, preferably 10,000 Kgf/mm$^3$ or less. This value of the Young's modulus is exhibited in a state of the face portion immediately after the rolling or heat treatment ends or in another state thereof resembling the former.

A test was conducted to confirm a flying distance produced by a golf club having a club head thus constructed. In the test, two types golf clubs were manufactured, a golf club having a conventional club head and golf clubs having club heads constructed according to the invention. A head speed was 40 m/s for both the club heads. For the flying distance, 100 is assigned to a flying distance by the golf club with the conventional club head, and a flying distance by the golf club with the club head constructed according to the invention was calculated with respect to 100. The test results are shown in Table 1.

TABLE 1

| | Material | E | l | h | A | FlD |
|---|---|---|---|---|---|---|
| Comparative head | Ti-6Al-4V by casting | 11550 | 44 | 3.0 | 0.273 | 100 |
| Head 1 by invention | Ti-6Al-4V by casting | 11550 | 65 | 3.0 | 0.881 | 104 |
| Head 2 by invention | Ti-15Mo-5Zr-3Al | 11900 | 52 | 2.4 | 0.855 | 103 |
| Head 3 by invention | FRM Ti-6Al-4V—SiC | 12900 | 52 | 2.3 | 0.895 | 104 |

Note) E : Young's modulus (Kgf/mm$^3$)
l : Vertical dimension of the face portion (mm)
h : Thickness of the face portion (mm)
A : $1/E \times (1/h)^3$
FlD : Flying distance Reinforced fiber of FRM in the head 3 was oriented in the vertical direction of the face portion.

As seen from the above table, the golf clubs having the club heads constructed using the face portions manufactured as specified in the table are all improved in their flying distance.

While the invention is applied to the golf club of the wood type, it may be applied to the golf club of the iron type.

As seen from the foregoing description, in the club head constructed as described above, a flexure amount of the face portion mounted on the club head, which is produced when striking the ball, is optimized. There is no chance that the face portion is extremely deformed when striking the ball. The face portion exhibits a large coefficient of restitution for the ball. This leads to increase of the flying distance and the directional stability.

(3) The present invention further provides a golf club head having a face plate made of fiber reinforced metal as a metal reinforced with reinforced fibers. A surface treatment layer is formed on the surface of the face plate, and a metal layer is formed between a reinforced fiber layer and the surface treatment layer.

The surface treatment layer may be formed on the surface of the face plate by changing the properties of the surface per se or coating the surface with another material. Thus, the surface treatment layer is layered on the surface of the face plate, which is liable to be worn or impaired with an impact when hitting the ball. Therefore, there is no chance of exposing reinforced fibers and impairing the same by the impact. Further, the reinforced fibers may be disposed close to the outside. With the formation of the surface treatment layer, a material having such a property that interfacial separation little occurs between the material and the reinforced fibers and that does not deteriorate the reinforced fibers may be used. Therefore, a percentage of the reinforced fibers in the matrix may be increased to increase a strength of the face plate.

Figure 13A:
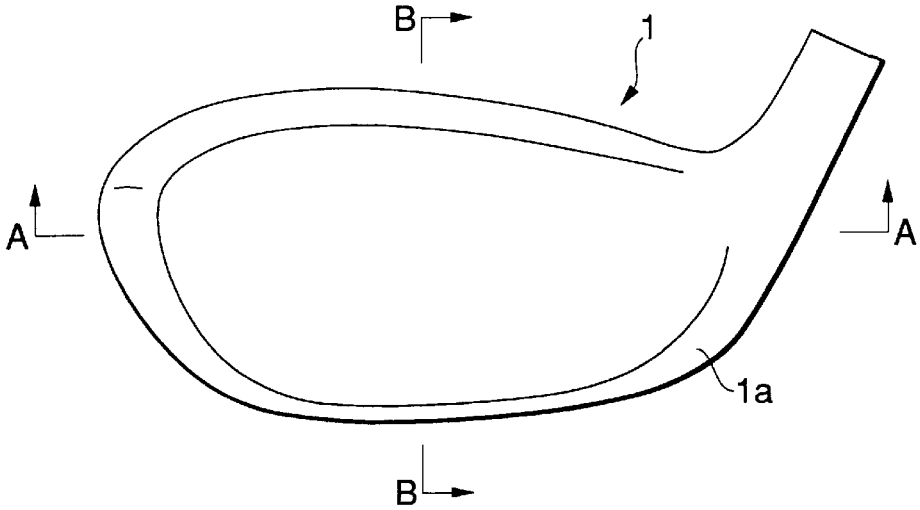
FIGS. 13(*a*) to 13(*c*) show a wood type club head of a golf club.
Figure 13B:
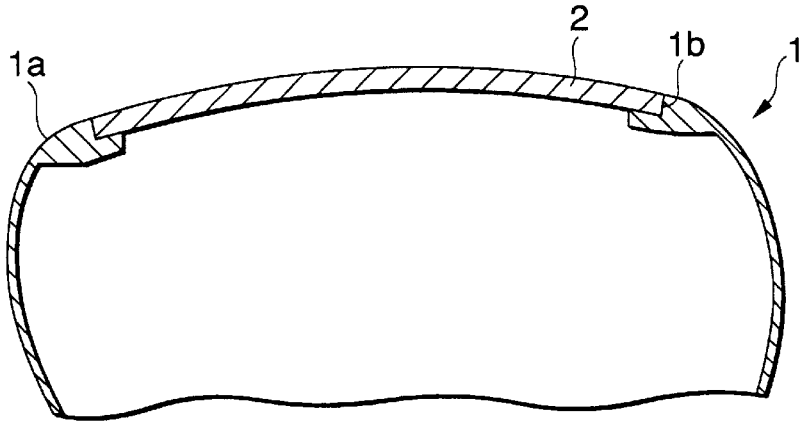
Figure 13C:
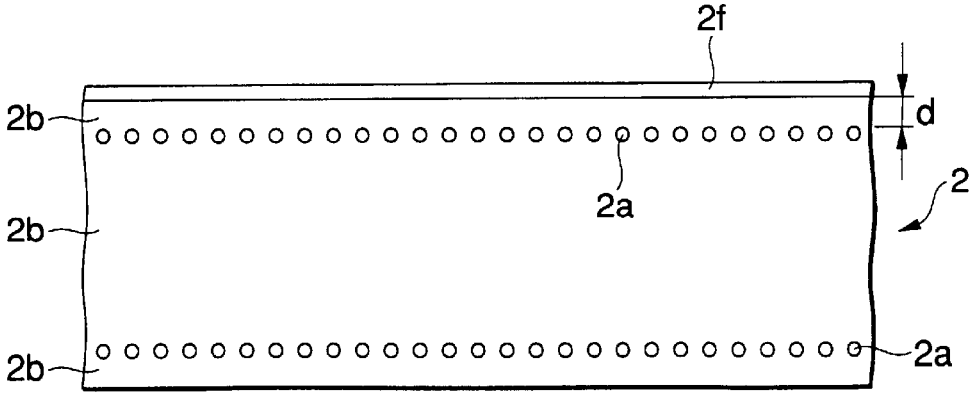

FIG. 13(*a*) is a front view showing a club head of a wood type; FIG. 13(*b*) is a cross sectional view taken on line A—A; and FIG. 13(*c*) is an enlarged view showing a face plate of the club head.

A club head 1 of the hollow type is formed in a manner that a metal, e.g., stainless steel, titanium, or titanium alloy, is molded into a one-piece construction by casting or in a manner that shell members, e.g., a sole portion, crown portions and the like, are individually formed by forging, and those are welded into a unit form. A face portion 1*a* of the club head has a recess 1*b*. A face plate 2 is mounted on this recess 1*b* by a known method, e.g., welding, press fitting, or bonding.

The face plate 2 is made of FRM (fiber reinforced metal) in which a metal (matrix) is reinforced with reinforced fibers. As shown in FIG. 13(*c*), the face plate 2 includes a reinforced fiber layer 2*a* in which reinforced fibers are orientated in the vertical direction of the club head, and a metal layer 2*b* disposed sandwiching the reinforced fiber layer 2*a* therebetween. The reinforced fibers of the reinforced fiber layer 2*a* may be made of, for example, silicon carbide or boron, and the matrix of the metal layer 2*b* may be made of, for example, titanium or an aluminum alloy. The materials for the reinforced fiber layer 2*a* and the metal layer 2*b* are not limited to those enumerated, as a matter of course. There is not any special limiting conditions on the orientation of the reinforced fibers. In a case where the face plate is long in the horizontal direction (toe/heel direction), a deformation amount of the face plate per unit length at-a ball hitting position is larger in the vertical direction than in the horizontal direction. Therefore, to secure an effective reinforcing, it is desirable to orient the reinforced fibers in the vertical direction. The layer structure of the reinforced fiber layer and the metal layer may be modified and altered variously, as a matter of course.

A surface treatment layer 2*f*, which is good in resistance-to-wear and high in hardness, is formed on the matrix surface to be used as a hitting face of the face plate 2 by any of the following methods (1) to (3). The surface treatment layer 2*f* is provided for protecting the matrix surface from wearing and flawing. A material of the surface treatment layer 2*f* may be any material if it is excellent in resistance-to-wear and high in hardness. When the surface treatment layer 2*f* is used for adjusting a hitting feel and a spinning amount of the ball, it may be coated with a synthetic resin or a soft metal, which is softer than the matrix, for example, acrylic resin coating.

(1) To nitride or anodize the matrix surface of the face plate 2, which is to be used as the hitting surface.

The matrix surface thus processed is improved in hardness. Therefore, there is no chance that the matrix surface is worn or flawed, and the flaw grows into the face plate. The reinforced fiber layer 2*a* may be located apart from the neutral axis as much as possible, viz., near to the surface of the face plate. As a result, a rigidity of a portion on the face plate which is most flexed when hitting the ball is improved, so that the resultant face plate is good in strength, thinned and reduced in weight. The surface treatment layer 2*f* may extremely be thinned, and therefore presence of the surface treatment layer 2*f* a little contributes to increase of the weight of the whole face plate.

(2) A film, which is to be used as the surface treatment layer 2*f*, is formed on the matrix surface of the hitting surface of the face plate 2 by spray coating, plating, coating, or the like. For the material for spraying coating, a resistance-to-wear material, e.g., corrosion-proof metal or ceramics, is preferably used when the matrix 2*b* is pure titanium, for example, since the pure titanium is poor in resistance-to-wear. For the material for plating, nickel, boron, chromium or the like is preferably used when the matrix 2*b* is a material of HV400 or smaller since the plating material is flawed and its strength is reduced. For the material for coating, acryl of high hardness, for example, is used when the matrix 2*b* is a titanium alloy. In this case, after the mounting of the face plate, the resultant is frequently subjected to heat treatment, and hence, a further increase of temperature needs to be avoided. It is for this reason that the acryl of high hardness is used.

The formation of the surface treatment layer 2*f* on the matrix surface produces the following advantages as in the method (1). The reinforced fiber layer 2*a* may be located apart from the neutral axis as much as possible. The resultant face plate is good in strength, thinned and reduced in weight. Plating of nickel, chromium or the like is used for the surface treatment layer 2*f*, the resistance-to-wear effect is actualized at the thickness of 0.01 mm to 0.3 mm.

(3) Vapor deposition, sputtering, PVD (e.g., ion plating), CVD, plasma CVD or the like may further be used for forming the surface treatment layer 2*f*. In this case, CR, Ni, Ti, Al, Ag, Be or the like is preferably used for the material of the surface treatment layer 2*f*.

If the PVD or CVD is used for forming the surface treatment layer 2*f*, the resultant layer is extremely thin, thereby achieving the weight reduction and strength improvement.

A plural number of surface treatment layers may be formed on the matrix. For example, an intermediate layer (or layers) of good adhesion is layered on the matrix, and a hard layer is layered on the intermediate layer.

Formation of the surface treatment layer enables the reinforced fiber layer 2*a* to be located close to the surface of the face plate. As a result, a high strength and the thinning of the face plate, and the weight reduction of the club head are realized. In a specific example, silicon carbide was used for the reinforced fiber, Ti was used for the matrix as the metal layer, and a surface treatment layer 2*f* was formed by the method (1). The reinforced fiber layer 2*a* could be disposed so that the thickness d of the metal layer shown in FIG. 13(*c*) was 0.1 to 0.5 mm thick. Therefore, the face plate having a thickness 1.5 to 2.8 mm gives rise to a strength substantially equal to that of the conventional one.

The surface treatment layer forming methods (1) to (3) may properly be combined in accordance with the characteristic of the club head and the material of the face plate. The formation of the surface treatment layer 2*f* on the matrix of the face plate improves the wear resistance and hardness of the face plate. Therefore, a material having such a property that interfacial separation little occurs between the material and the reinforced fibers may be used. In other words, a metal, such as magnesium, copper, aluminum bronze, or beryllium kappa, may be used in addition to the materials used for the conventional face plate.

Figure 14A:
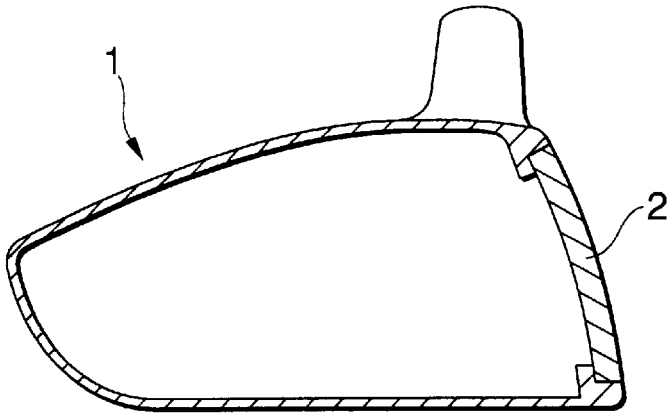
FIG. 14(*a*) is a cross sectional view taken on line B—B in FIG. 13(*a*), and FIG. 14(*b*) is an enlarged view showing a face plate in FIG. 14(*a*).
Figure 14B:
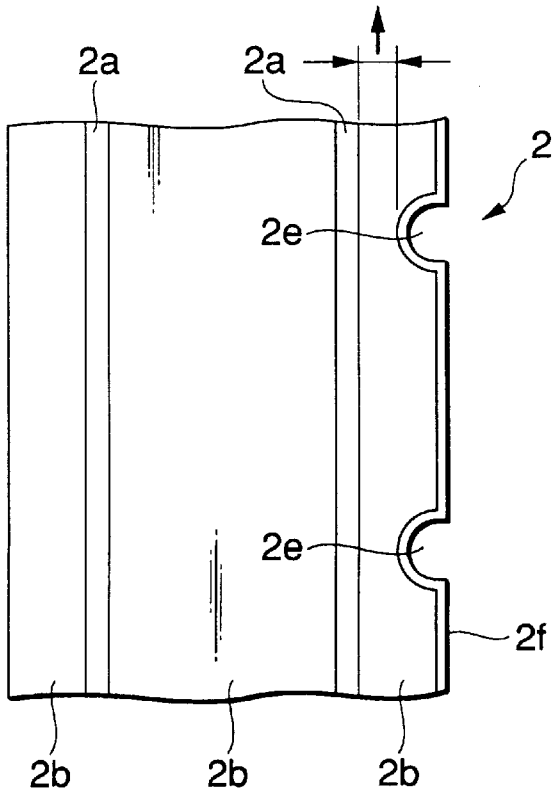
Figure 16:
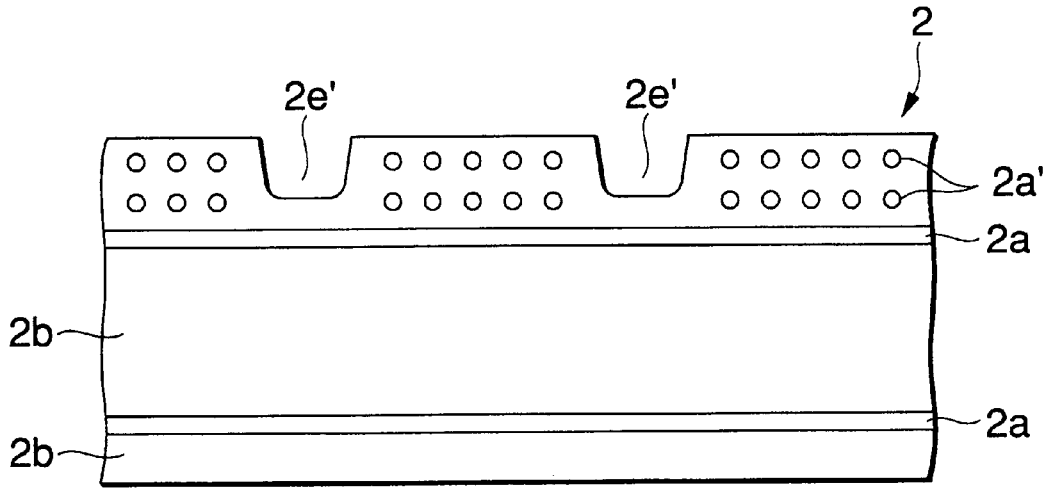
FIG. 16 is a view showing another type of score lines.

FIG. 14(*a*) is a cross sectional view taken on line B—B in FIG. 13(*a*), and FIG. 14(*b*) is an enlarged view of the face plate shown in FIG. 14(*a*). Usually, score lines 2*e* like grooves are formed in the surface of the face plate 2, while extending in the toe/heel direction. The score lines 2*e* belong to a portion liable to change its shape. Therefore, stress concentrates at the score lines 2*e* when the face plate is flexed by hitting the ball, and the score lines are liable to crack or flaw. Each score line is rectangular in cross section; in the cross section of each score line, side walls intersect the bottom wall at a given angle (FIG. 16). Stress is apt to concentrate at the corners where the bottom wall intersect the side walls. The corners are liable to crack and flaw, and the reinforced fibers are liable to be impaired.

One of the effective approaches to avoid the stress concentration in the score lines is to configure the cross section of each score line in a semicircular shape as shown in FIG. 14(*b*). By so doing, stress is dispersed to lessen a chance of formation of crack and flaw at the score lines and of impairing of reinforced fibers. In a specific example, a distance t between the bottom surface of each score line and the reinforced fibers layered on the metal layer may be set at approximately 0.1 mm, whereby the reinforced fiber layer may be disposed close to the surface of the face plate. Another approach to avoid the stress concentration is to curve the corners of each score line where the side walls intersect the bottom wall at a given curvature.

Formation of a surface treatment layer 2*f* on the face plate having score lines 2*e* formed in the surface thereof enables the face plate to further be thinned and reduced in weight. Further, it effectively prevents the score lines from cracking or flawing.

Figure 15:
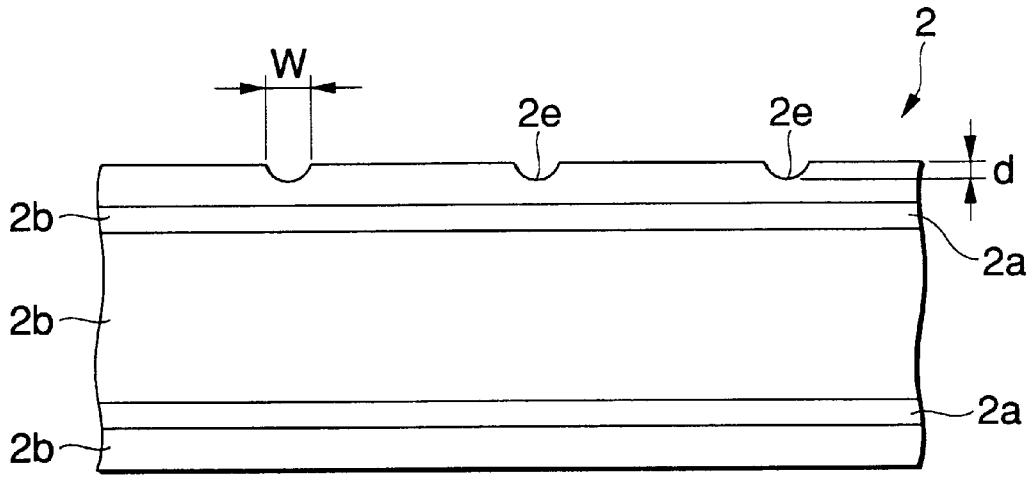
FIG. 15 is a view showing score lines of shallow grooves, semicircular in cross section, which are formed in the surface of the face plate.

The score lines, semicircular in cross section, which are formed in the surface of the FRM face plate, are preferably shallow as shown in FIG. 15. Specifically, each score line is formed so as to satisfy w>d where w is the width of each score line and d is the depth of the score line. The reason for this is that in the case of the RFM face plate, the reinforced fibers need to be located apart from the neutral axis as much as possible. If the score lines are shallow, the reinforced fibers may be located correspondingly closer to the surface of the face plate (much apart from the neutral axis). Therefore, the resultant face plate is improved in strength, the thinning and weight reduction. Also in this case, use of the surface treatment layer is preferable.

Another type of score lines is shown in FIG. 16. The score lines, like the conventional ones, are of the deep groove type, and the corners of the bottom of the score line groove are not curved. Reinforced fibers 2*a*' are arranged between the adjacent score lines while parallel to the latter. With this feature, the score lines may be formed not cutting the reinforced fibers, and therefore a satisfactory strength at the score line portions is secured. The reinforced fiber layer 2*a* located under the score lines 2*e* and the reinforced fiber layer 2*a*' located between the adjacent score lines 2*e* cooperate to provide a high strength. Therefore, the thinning and weight reduction of the face plate are realized. Formation of the surface treatment layer is preferable also in this case, as a matter of course.

How to form the score lines as mentioned above will be described.

The score lines may be depicted on the face plate by an engraving machine, laser machine, water jetting machine or the like. When the engraving machine is used, the score lines may be depicted while free from heat, solvent and others. Accordingly, the strength of the face plate is kept as it is. When the laser machine or the water jetting machine is used, the score lines may be depicted the cross section of which is semicircular in cross section. Therefore, the stress concentration is avoided, and the reinforced fibers are not impaired.

The score lines may be formed on the surface of the face plate by pressing. In this case, an adhesion of the matrix to the reinforced fibers is good, and a composite reinforced material further increased in strength is provided.

Figure 17:
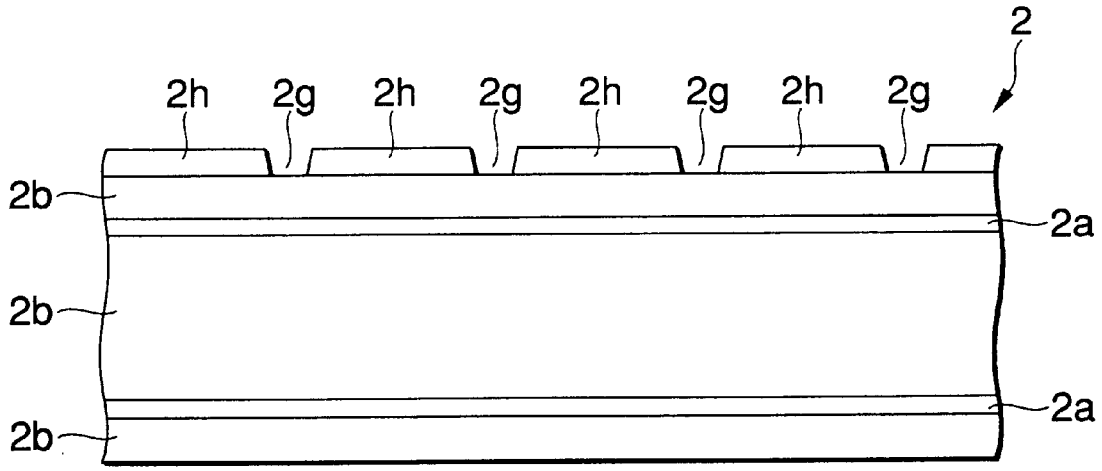
FIG. 17 is a view showing a method of forming score lines in the surface of the face plate.

The score lines of the shallow groove type may be formed in a manner that the surface of the face plate, except the areas where score lines are to be formed, is masked and subjected to etching process. In this case, the score lines may be formed with uniform depths while not impairing the reinforced fibers. The result score lines are semicircular in cross section. Therefore, the problem of stress concentration and impairing of the reinforced fibers does not arise. As shown in FIG. 17, score lines may be formed in a manner that areas 2*g* where score lines are to be formed are masked, and an additional layer 2*h* is formed on the structure by plating, vapor deposition, spray coating, coating or the like. A material of the layer 2*h* is properly selected in accordance with the layer forming process employed, and preferably nickel when considering production efficiency, wear resistance and the like. In this case, plating process is used for forming the layer.

Use of the additional layer enables the score lines to be formed without impairing the reinforced fibers, and allows the reinforced fibers to be located closer to the outside. The score lines may be formed in the form of simple patterns or artistic patterns by coarsening the surface of the face plate or forming a film on the same.

While the score lines shaped like grooves are formed on the surface of the face plate in the above-mentioned embodiment, score lines, not grooved but having the same functions as of the grooved score lines, may be formed on the surface of the face plate. Such score lines may be formed by coarsening the linear areas where the score lines are to be formed. Specifically, the surface of the face plate except the areas where the score lines are to be formed is masked, and sand blasted, or a film of a material of high friction coefficient is formed thereon by plating, vapor deposition, spray coating, coating or the like. Further, particles are sprayed onto the surface of the face plate, and at this time the surface is subjected to heat treatment (WPC process). The WPC process is attendant with work hardening of heat treatment effect and forging effect. If the process is applied to the entire surface of the face plate having score lines already formed, the entire surface is hardened, so that wear resistance and flaw resistance of the face plate are enhanced and protection of the reinforced fibers is also enhanced.

With the selective coarsening of the surface of the face plate, there is no need of grooving the score lines. Therefore, the reinforced fibers may be disposed closer to the outside. The resultant face plate is improved in strength, thin and reduced in size. The score lines by surface coarsening properly increases a spinning motion of the ball.

Figure 18:
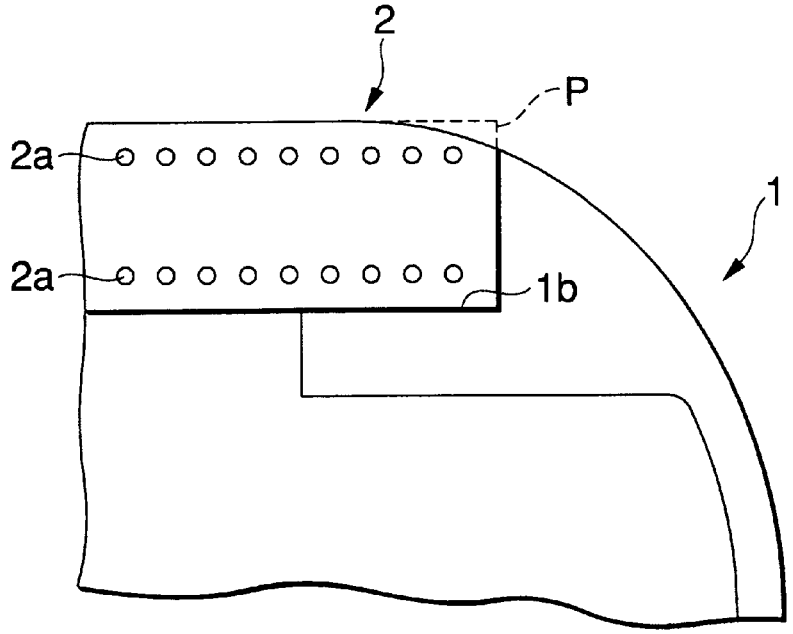
FIG. 18 is a view showing a joint portion of the club head and the face plate.

As described above, it is desirable that the reinforced fibers are disposed closest to the outside. After the face plate 2 is actually fit to the recess 1*b* of the club head 1, the surface of the face plate 2 is sometimes abraded so that the frame surface of the club head is flush with the surface of the face plate 2 (indicated by P in FIG. 18). Where such an abrasion process is used, the reinforced fiber layer 2*a* is located at such a position that the reinforced fiber layer is not exposed through the abrasion process. Sometimes, the reinforced fibers are exposed as the result of abrading. In this case, a surface treatment layer is applied onto the fiber exposed surface so as to cover them with the surface treatment layer.

While the invention has been described using the wood type golf club, the invention may be applied to the iron type gold clubs and putters.

As seen from the foregoing description, a face plate of the club head which has a high strength can be provided. Therefore, the thinning and weight reduction of the face plate are realized. With such advantageous features of the face plate, a designer can design the club head at increased design freedom, and easily design golf clubs satisfying required characteristics. And besides, the golf club whose portion used for hitting the ball is improved in durability is provided.

What is claimed is:

1. A golf club head defined by a face portion, an upper face portion, a toe-side portion, a heel-side portion, a sole portion, and a back-face portion, wherein at least one of said portions is partitioned by thick portions or rib portions into a plurality of segments each having a long-dimension direction and a short-dimension direction, and at least one of said segments satisfies at least one of the following conditions:

1) a longitudinal direction of crystal grains of a material of said segment is oriented in said short-dimension direction;

2) a direction in which said material exhibits a large ductile amount at the time of breaking is oriented in said short-dimension direction; and 3) a direction in which said material exhibits a large ratio of ductility per unit length is oriented in said short-dimension direction.

2. A golf club head defined by a face portion, an upper face portion, a toe-side portion, a heel-side portion, a sole portion, and a back-face portion, said portions being at least partially distinguished from another by ridge lines wherein each of said portions satisfies at least one of the following conditions:

1) a longitudinal direction of crystal grains of a material of said portion is oriented in a direction perpendicular to a corresponding ridge lines contiguous with said portion;

2) a direction in which said material exhibits a large ductile amount at the time of breaking is oriented in said direction perpendicular to said corresponding ridge line contiguous with said portion; and 3) a direction in which said material exhibits a large ratio of ductility per unit length is oriented in said direction perpendicular to said corresponding ridge line contiguous with said portion.

3. A golf club head having a front side onto which a face portion is mounted, wherein a value of $1/E\times(1/h)^3$ of said face portion is within a range from 0.8 to 16.0, where E : Young's modulus 1: maximum vertical dimension of the face portion in the vertical direction h: thickness of the face portion.

4. A golf club head having a front side onto which an all-metallic face portion formed of a single metallic plate is provided with at least one of a rib and a thick portion, wherein, if said face portion is sliced along lines on a regional portion including a position where said face portion takes a maximum dimension in a vertical direction to form a test piece of 10 mm wide, then a flexure amount $\sigma$ of said test piece, when measured by a flexure measuring method X, is within a range from 1 mm to 1.25 mm.

* * * * *